US010187955B2

(12) United States Patent
Pamato et al.

(10) Patent No.: US 10,187,955 B2
(45) Date of Patent: Jan. 22, 2019

(54) DETECTION OF SINGLE SHORT-LED IN LED CHAINS

(71) Applicant: Infineon Technologies AG, Neubiberg (DE)

(72) Inventors: Marco Pamato, Schio (IT); Maurizio Galvano, Padua (IT); Roberto Guerra, Sacile (IT); Aurelio Pellegrini, Sestola (IT); Damiano Sartori, Padua (IT); Enrico Tonazzo, Villanova di Camposampiero (PD) (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/634,809

(22) Filed: Jun. 27, 2017

(65) Prior Publication Data

US 2018/0359824 A1 Dec. 13, 2018

Related U.S. Application Data

(60) Provisional application No. 62/517,451, filed on Jun. 9, 2017.

(51) Int. Cl.

| | |
|---|---|
| ***H01J 1/60*** | (2006.01) |
| ***H01J 7/42*** | (2006.01) |
| ***H05B 37/04*** | (2006.01) |
| ***H05B 33/08*** | (2006.01) |

(52) U.S. Cl.
CPC ..... *H05B 33/089* (2013.01); *H05B 33/083* (2013.01)

(58) Field of Classification Search
None
See application file for complete search history.

(56) References Cited

U.S. PATENT DOCUMENTS

| | | | | |
|---|---|---|---|---|
| 9,502,958 | B2 | 11/2016 | Pamato et al. | |
| 9,544,971 | B2 | 1/2017 | Pamato et al. | |
| 9,835,668 | B2 * | 12/2017 | Kriebernegg | G01R 31/025 |
| 2010/0264828 | A1 | 10/2010 | Cortigiani et al. | |

(Continued)

FOREIGN PATENT DOCUMENTS

CN 106199299 A 12/2016

OTHER PUBLICATIONS

"TPS9263x-Q1 Three-Channel Linear LED Driver With Analog and PWM Dimming," TPS92630-Q1, TPS92631-Q1, Feb. 2014, revised Jan. 2015, 40 pp.

*Primary Examiner* — Anh Tran
(74) *Attorney, Agent, or Firm* — Shumaker & Seiffert, P.A.

(57) ABSTRACT

The disclosure is directed to a circuit that may detect a single short in a chain of loads, such as light emitting diodes (LEDs). The circuit may drive either multiple LED chains or a single LED chain to determine whether one, or more, of the LEDs in the LED chain is no longer working because of a short. The circuit determines whether the LED chain voltage satisfies a threshold based on a single LED voltage drop. Therefore, the same circuit may be used for applications regardless of the number of LEDs in an LED chain. Additionally, the circuit, according to the techniques of this disclosure may use may use no output pins, other than those used to deliver current to LED chains, regardless of the number of LED chains that the circuit drives.

20 Claims, 6 Drawing Sheets

(56) References Cited

U.S. PATENT DOCUMENTS

| | | | | |
|---|---|---|---|---|
| 2011/0037407 | A1* | 2/2011 | Ahn | H05B 33/0827 315/287 |
| 2012/0074856 | A1* | 3/2012 | Takata | H05B 33/0815 315/192 |
| 2012/0074947 | A1 | 3/2012 | Cortigiani et al. | |
| 2013/0314064 | A1* | 11/2013 | Theiler | G09G 3/3406 323/282 |
| 2016/0050732 | A1* | 2/2016 | Lin | H05B 33/089 315/121 |
| 2016/0349304 | A1 | 12/2016 | Sartori et al. | |

* cited by examiner

DETECTION OF SINGLE SHORT-LED IN LED CHAINS

TECHNICAL FIELD

The disclosure relates to failure detection in chains of electrical loads.

BACKGROUND

For a circuit device that drives one or more branches with chains of electrical loads, such as a chain of light emitting diodes (LEDs), it may be desirable to detect a failure in one of the loads. In the example of a load that fails for an open circuit, the current will stop flowing for the branch with the open circuit. The circuit device may detect that the current stopped for that branch and therefore detect the open circuit failure. In the example of a load that fails for a short circuit, detection of a load failure in a chain of loads may be more challenging.

SUMMARY

In general, the disclosure is directed to a circuit that may detect a single short in a chain of loads, such as light emitting diodes (LEDs). The circuit may drive either multiple LED chains or a single LED chain to determine whether one, or more, of the LEDs in the LED chain is no longer working because of a short. The circuit determines whether the LED chain voltage satisfies a threshold based on a single LED voltage drop. Therefore, the same circuit may be used for applications regardless of the number of LEDs in an LED chain. Additionally, the circuit, according to the techniques of this disclosure may use may use no output pins, other than those used to deliver current to LED chains, regardless of the number of LED chains that the circuit drives.

In one example, the disclosure is directed to circuit comprising a short detection circuit comprising: a single short detection output element; and a selector circuit configured to receive a series load voltage from each output element of the one or more output elements and select one series load voltage from the one or more output elements, wherein the short detection circuit is configured to: compare the selected series load voltage to a predetermined a threshold voltage value, and in response to the selected series load voltage satisfying the predetermined threshold voltage value the short detection circuit is configured to output a short detection signal at the single short detection circuit output.

In another example, the disclosure is directed to system comprising: a plurality of LED strings, wherein: each LED string in the plurality of LED strings includes N LEDs in series, wherein N is an integer greater than one, and each LED of the N LEDs in an LED string has an expected forward voltage drop; a driver circuit comprising a plurality of output elements, wherein: each respective output element is coupled to a respective LED string, and the driver circuit is configured to deliver a respective output current from each respective output element to each respective LED string; a selector circuit configured to select a series load voltage of a plurality of series load voltages, wherein each respective series load voltage of the plurality of series load voltages corresponds to a respective LED string of the plurality of LED strings; a comparison circuit configured to: determine whether the selected series load voltage satisfies a predetermined threshold voltage value, and in response to determining the selected series load voltage satisfies the predetermined threshold voltage value, output a short circuit detection signal.

In another example, the disclosure is directed to a method comprising: delivering, by a short detection circuit and to each output element of one or more output elements of the short detection circuit, an output current to each series load coupled to each output element, wherein: each series load comprises N loads, and N is an integer greater than one; determining, by the short detection circuit, a respective series load voltage for a respective series load of the one or more series loads coupled to the one or more output elements; selecting, by the short detection circuit, a selected series load voltage from the one or more series load voltages; determining, by the short detection circuit, whether the selected output voltage satisfies a predetermined threshold voltage value; and in response to determining that the selected output voltage satisfies the threshold voltage value, outputting, by the short detection circuit a short detection signal.

The details of one or more examples of the disclosure are set forth in the accompanying drawings and the description below. Other features, objects, and advantages of the disclosure will be apparent from the description and drawings, and from the claims.

DETAILED DESCRIPTION

The disclosure is directed to a circuit that may detect a single short in a chain of loads, such as a chain of light emitting diodes (LEDs). The circuit may drive either multiple LED chains or a single LED chain to determine whether one, or more, of the LEDs in the LED chain may no longer be working because of a short. The circuit determines whether the LED chain voltage satisfies a threshold based on a single LED voltage drop. Therefore, the same circuit may be used regardless of the number of LEDs in an LED chain.

The techniques of this disclosure are based on the comparison between the maximum and/or minimum voltage of LED chains and a threshold voltage. The threshold voltage may be generated internal to the circuit, for example, within an integrated circuit (IC), or provided external to the circuit. One advantage of the techniques of this disclosure is that only no additional or dedicated output pins, other than those used to deliver current to LED chains. Other examples of short detection circuits may require additional and dedicated pins. In some examples a dedicated short detection pin is required for each chain of LEDs. In other words, some short detection circuits that drive five chains of LEDs may require at least five additional short detection output pins. Other example LED short detection circuits may include a digital communication bus along with digital logic and registers to determine whether an LED in multiple chains of LED has failed. In contrast, a circuit according to the techniques of this disclosure may have may use no additional or dedicated output pins other than those used to deliver current to LED chains. A circuit according to this disclosure may provide advantages over other detection circuits including fewer pins, smaller size and reduced complexity.

The techniques of this disclosure may be applied both to single and multichannel LED drivers. A circuit according to the technique of this disclosure may provide flexibility to use a multichannel-driver with some, or all, channels shorted to each other without losing the ability to detect the single LED short. For example, in some applications the user may short one or more of the channels of a multi-channel driver circuit together to increase the current flowing through in a single chain of LEDs. A multichannel circuit according to this disclosure, where all channels are shorted together to drive a single LED chain, may still detect a single shorted LED in the single LED chain. A circuit according to this disclosure may provide advantages over other types of short detection circuits, including providing one model of IC that may be used in either multichannel or single channel applications. The ability of one model to satisfy many applications may provide advantages such as reduced inventory, reduced manufacturing costs, simplified product selection, and similar advantages.

Figure 1A:
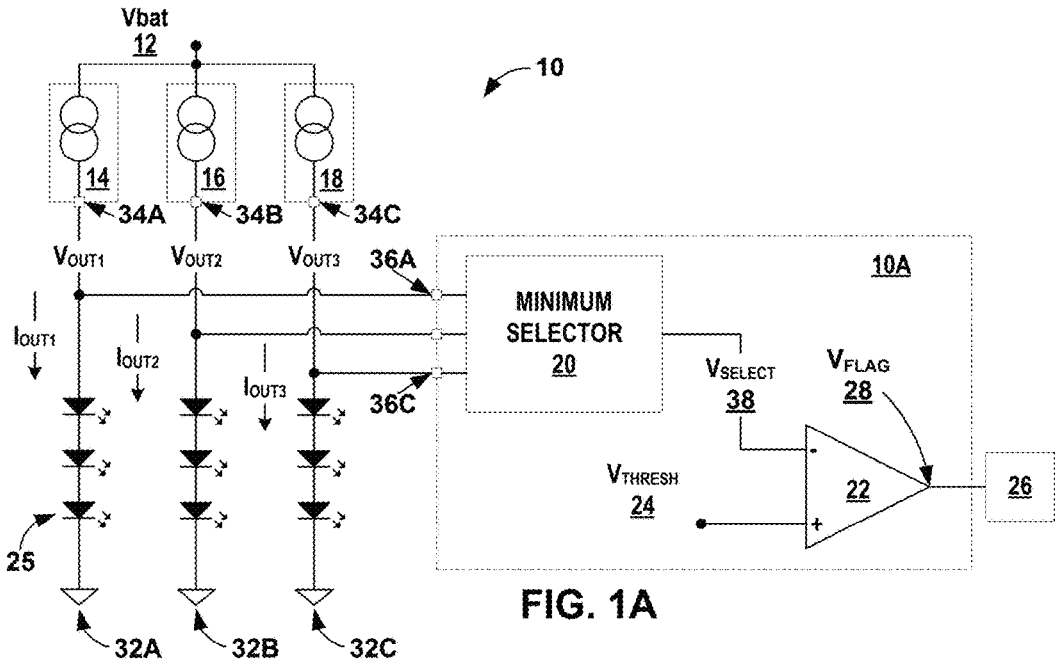
FIG. 1A is a schematic and block diagram illustrating an example high side driver, multi-channel circuit to detect a shorted load in a series of loads, according to one or more techniques of this disclosure.

FIG. 1A is a schematic and block diagram illustrating an example high side driver, multi-channel circuit to detect a shorted load in a series of loads, according to one or more techniques of this disclosure. Circuit 10, may include current sources 14-18 to deliver to each output element of one or more output elements (34A-34C) of the circuit, an output current (Iout1-Iout3) to a series load (32A-32C) coupled to each output element. Circuit 10, which includes both circuit 10A and the current sources 14-18, may be considered a short detection circuit. In other examples, circuit 10A may be considered the short detection circuit and be separate from the current source circuitry, but connected to the current source outputs 34A-34C via terminals 36A-36C. In other words, a short detection circuit may include just circuit elements such as a selector circuit and a comparison circuit as shown in circuit 10A. In other examples, a short detection circuit may also include the driver elements, such as current sources 14-18, or other types of driver elements. In this disclosure, the term current driver may be used to refer to a current source. In other words, in some examples a short detection circuit may include sources, such as current sources, to supply the series loads. In other examples, a short detection circuit may have no sources to supply the series loads, but may be coupled to the output of a source to determine the series load voltage at the output.

Current sources 14-18 may comprise any type of current source, such as a current regulator, that may supply current. Current sources 14-18 receive power from Vbat 12, as depicted in the example of FIG. 1A, however, Vbat may indicate any power source, such as a regulated power supply, and need not be limited to a battery. Each current source includes an output element (34A-34C). Current sources 14-18 supply an output current (Iout1-Iout3) to the anode side of each series load (32A-32C) coupled to each output element 34A-34C. The cathode side of each series load 32A-32C is coupled to ground.

Figure 2A:
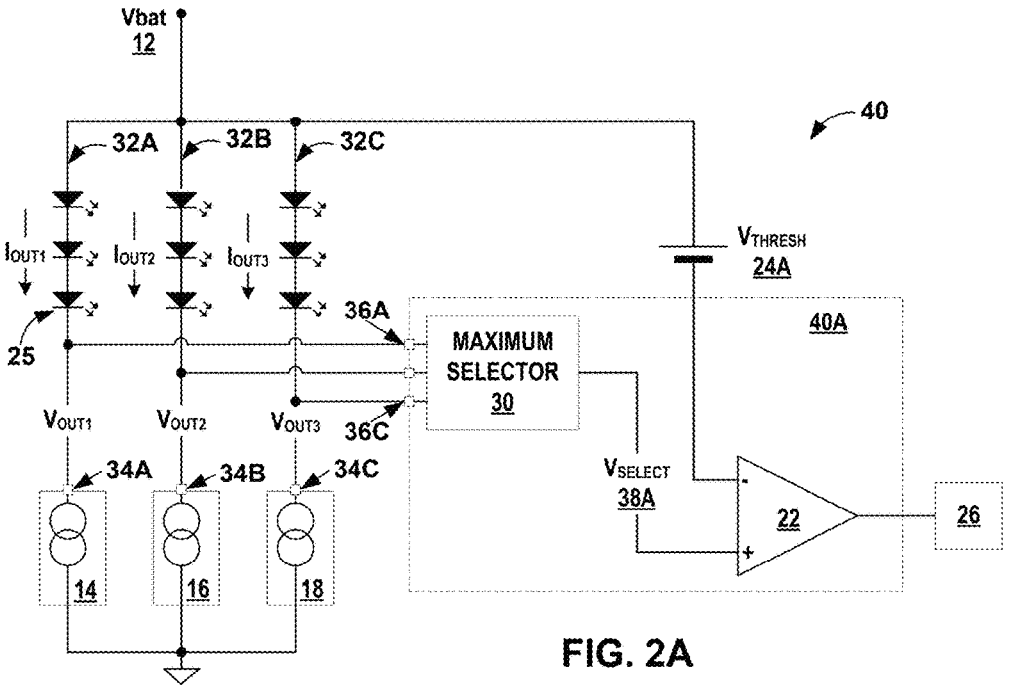
FIG. 2A is a schematic and block diagram illustrating an example low side driver, multi-channel circuit driving multiple series loads of LEDS.

FIGS. 1A and 2A depict three series loads, however, other examples of circuits 10 and 40 may include more or fewer than three series loads. Throughout this disclosure, a series load may also be referred to as a branch load, an LED chain. In other words, series loads 32A-32C may be considered branch loads 32A-32C of the plurality of loads supplied by circuits 10 or 40. Another way of describing circuits 10 or 40 may be as a multi-channel circuit supplying three channels. Other examples, such as FIGS. 3A and 4A below may be described as a multi-channel circuit supplying a single channel, or single series load.

Current source 14 connects to series load 32A, which includes LED 25. To simplify the figures and the explanation, this disclosure will focus on each load of the series load as an LED. In other examples, the loads may be other types of loads, such as light bulbs, power supplies and similar loads. The other LEDs in the series loads 32A-32C are not numbered. The example of FIG. 1A depicts each series load as including three LEDs, but in other examples, the series load may include any number of LEDs.

Circuit 10A may be considered a short detection unit of circuit 10. The term short detection circuit and short detection unit may be used interchangeably in this disclosure. Circuit 10A includes selector circuit, minimum selector 20, a comparison circuit, comparator 22, a threshold voltage, Vthresh 24 and an output Vflag 28. Circuit 10A may be coupled to each series load 32A-32C via terminals 36A-36C and receives the load voltages Vout1-Vout3. Respectively, terminal 36A connects to the anode side of series load 32A and receives load voltage Vout1, terminal 36B connects to the anode side of series load 32B and receives load voltage Vout2, terminal 36C connects to the anode side of series load 32C and receives load voltage Vout3. Terminal 36B is not labeled in FIG. 1A to simplify the diagram.

Figure 3A:
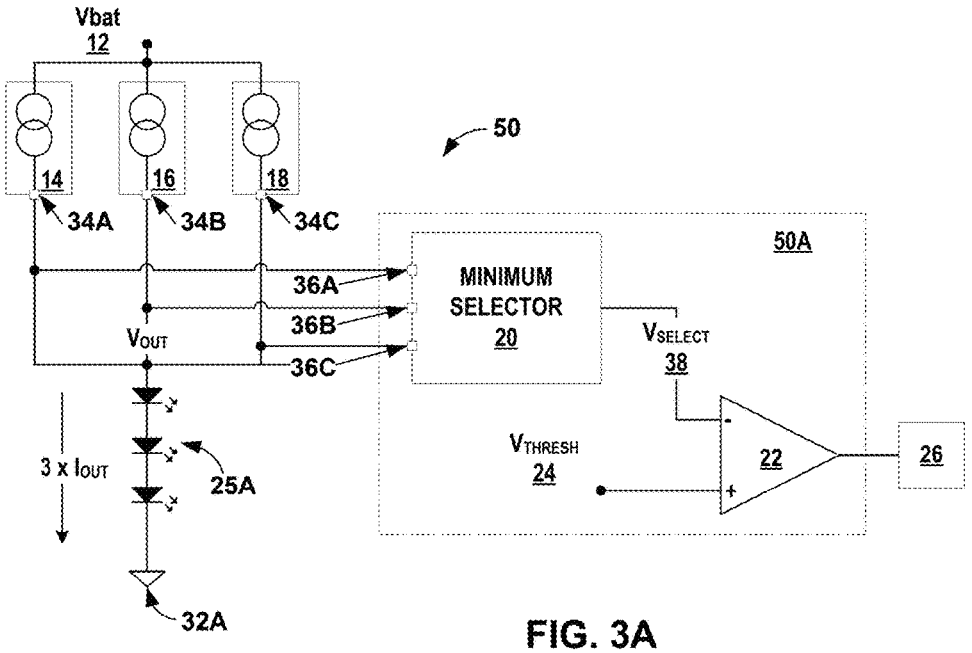
FIG. 3A is a schematic and block diagram illustrating an example multi-channel high side driver circuit driving a single series load that may be used to detect a shorted load in a series of loads, according to one or more techniques of this disclosure.

A driver circuit connected to the anode side of a series load of LEDs may be considered a high side driver circuit. A similar example high side driver circuit is depicted by FIG. 3A. A driver circuit connected to the cathode side of a series load of LEDs may be considered a low side driver circuit. Examples of low side driver circuits may be found in FIGS. 2A and 4A.

The load voltages Vout1-Vout3 depend on the series load rather than the output of the current sources 14-18. For example, series load 32A includes three LEDs, each with an LED voltage drop, $V_{LEDi}$. The series load voltage is then the sum of the LED voltage drops, $V_{LEDi}$, according to the equation:

$$V_{load} = \sum_{i=1}^{N} V_{LEDi}$$

In the example where all LED voltage drops in series load 32A are approximately the same, the series load voltage Vout1 for series load 32A is Vout1=N×$V_{LED}$=3×$V_{LED}$, where N is an integer representing the number of loads in series load 32A.

Selector circuit of circuit 10A may comprise a minimum selector 20. A minimum selector circuit, such as minimum selector 20, may be implemented using various techniques including logic circuits, microprocessor circuits, and other types of circuits that may be built of discrete components, integrated circuits (IC) or similar techniques. Minimum selector 20 receives a plurality of input voltages and selects the voltage that has the lowest voltage value. For example, where each LED of series loads 32A-32C is $V_{LED}$, each series load voltage would be approximately equal. In other words:

$$V_{out1}=V_{out2}=V_{out3}=N\times V_{LED}=3\times V_{LED}$$

and the output of minimum selector 20, Vselect 38 may be approximately 3$V_{LED}$. However, in the example in which LED 25 fails because of a short circuit, then Vout1=2×$V_{LED}$ and minimum selector 20 would select the lowest voltage. Therefore $V_{SELECT}$=Vout1=2$V_{LED}$. In some examples, a selector circuit, such as minimum selector 20, may contain a voltage divider/scaler to reduce the common mode voltage at the input of comparator 22. The voltage scaler can be applied to each output (36A-36C) or directly to the VSELECT 38 voltage. An example of this solution is used on the conceptual schematic of FIG. 5 below.

Circuit 10A includes a comparison circuit, which in the example of FIG. 1A is comparator 22. In other examples, circuit 10A may include other types of comparison circuits. Comparator 22 receives Vselect 38 into the inverting input and compares Vselect 38 to a predetermined threshold voltage $V_{THRESH}$ 24. In response to the selected series load voltage, Vselect 38 satisfying the predetermined threshold voltage value $V_{THRESH}$ 24, the short detection circuit, circuit 10A may be configured to output a short detection signal at the short detection output, which is the output of comparator 22, Vflag 28, in the example of FIG. 1A.

Other digital or analog circuits 26 may receive short detection signal Vflag 28 from the output of circuit 10A and use Vflag to perform other functions. In some examples the other functions may include sending a warning message or activating a warning indicator, such as an indicator light, that informs a user that there may be a short in one of the LEDs of the series LEDs.

Figure 1B:
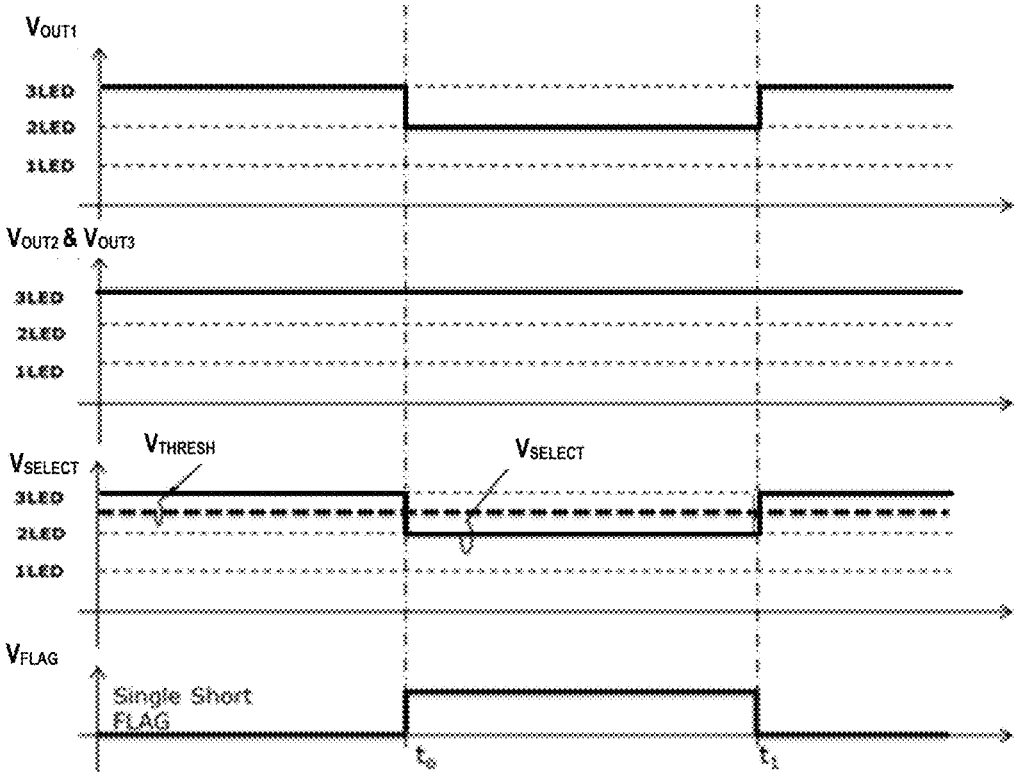
FIG. 1B is a conceptual timing graph that depicts the operation of a short detection circuit with a high side connected driver circuit, in accordance with one or more techniques of this disclosure.

FIG. 1B is a conceptual timing graph that depicts the operation of a short detection circuit with a high side connected driver circuit, in accordance with one or more techniques of this disclosure. The timing graph of FIG. 1B depicts the operation of FIG. 1A in the example where LED 25 has a short circuit failure.

The timing graphs of FIG. 1B include a graph of Vout1, a combined graph of Vout2 and Vout 3, a graph of Vselect 38 and a graph of Vflag 28. LED 25 develops a short circuit in the period t0 to t1, which means $V_{LED25}$ is approximately zero during the period t0 to t1. Vout1 is the series load voltage for series load 32A, and in the example of FIG. 1B, all LED voltage drops are approximately the same value, $V_{LED}$. Therefore, during the period t0 to t1, Vout1 will change from approximately 3$V_{LED}$ to approximately 2$V_{LED}$. The other series load voltages, Vout2 and Vout3 remain approximately constant during the period t0 to t1.

The selector circuit configured to receive a series load voltage Vout1-Vout3 from each output element 34A-34C of the one or more output elements is minimum selector 20. Minimum selector 20 may be configured to select the minimum series load voltage from the one or more output elements. At time t0, minimum selector 20 selects Vout1 and outputs Vout1 as Vselect 38. Therefore, at approximately t0, Vselect will also be approximately 2×$V_{LED}$, as shown in the example of FIG. 1B.

Vthresh 24, in the example, may be selected to be some fraction of $V_{LED}$ less than the expected series load for a fully functional series load. In the example of FIGS. 1A and 1B, Vthresh 24 is depicted as approximately $$3\times V_{LED}-0.5\times V_{LED}=(N-0.5)\times V_{LED}.$$

In other examples, the fraction of $V_{LED}$ may be different than ½ $V_{LED}$, such as ¾, ¼ or some other fraction of $V_{LED}$ that ensures the short detection circuit will detect a single shorted load in a series load, while avoiding a false detection indication.

In some examples, a series load may include LEDs that have different voltage drops. Vthresh 24 may be set to a fraction of the minimum LED voltage drop. For example, series load 32A may include three LEDs with voltage drops of 0.8V, 0.7V and 0.6V respectively. The expected series load may be the sum of $V_{LEDi}$=0.8V+0.7V+0.6V=2.1V. Vthresh 24 may be set to a fraction of the 0.6V drop less than the expected series load such as, such as 2.1V−½×0.6V=1.8V. In this example, the short circuit detection circuit will be configured to detect if any of the three LEDs fail for a short circuit.

Short detection circuit 10A can be configured to compare the selected series load voltage Vselect 38 to the predetermined a threshold voltage value, Vthresh 24, as described above. In response to the selected series load voltage Vselect 38 satisfying the predetermined threshold voltage value Vthresh 24, short detection circuit 10A may be configured to output a short detection signal Vflag 28 at the single short detection circuit output. In the example of FIG. 1A, a high side driver circuit, Vselect 38 satisfies the threshold Vthresh 24 when Vselect 38 is less than Vthresh 24 (Vselect≤Vthresh). In some examples, circuit 10A may be configured for Vselect 38 to satisfy the threshold when Vselect 38 is less than or equal to Vthresh 24 (Vselect≤Vthresh).

At approximately time t0, Vselect 38 satisfies Vthresh 24 and comparator 22 may output the short detection signal Vflag 28. At approximately time t1, the short circuit failure in LED 25 no longer exists, and Vout1 rises back to 3×$V_{LED}$. Vselect 38 also increases to 3×$V_{LED}$, and no longer satisfies the threshold Vthresh 24. In response, comparator 22 may cease to output the short detection signal Vflag 28 at time t1.

Figure 2B:
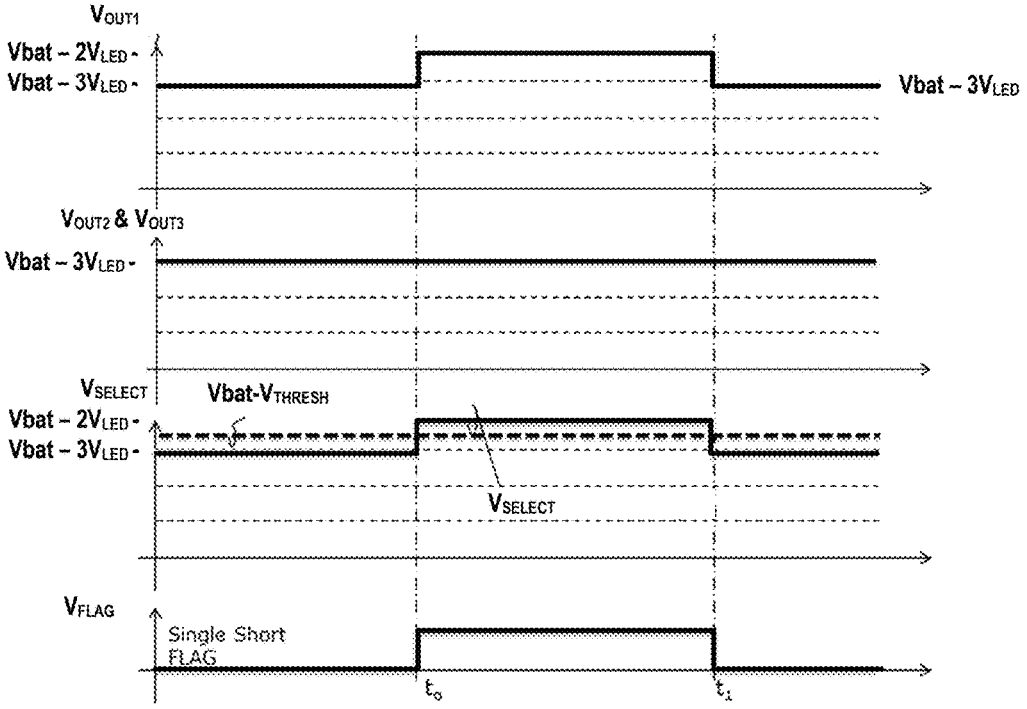
FIG. 2B is a conceptual timing graph that depicts the operation of a short detection circuit with a low side connected driver circuit, in accordance with one or more techniques of this disclosure.

The circuits of this disclosure may provide several advantages over other types of short detection circuits. As one example, no additional and dedicated pins are required, such as may be found in other short detection circuits that require a dedicated pin for each series load or branch load of LEDs. In other words, no additional or dedicated pins other than those used to deliver current to the LEDs are needed. In some examples, the output of comparator 22 does not need to be a dedicated pin. The output of comparator 22 may be just a connection to the circuit or system in charge of managing the LED short, such as the digital or analog circuits 26. Another advantage, as will be described below for FIGS. 2A and 2B, is the circuits, according to the techniques of this disclosure may be applied both to single and multichannel drivers. This provides flexibility to use a multichannel-driver with some or all channels shorted to each other without losing the ability to detect the single LED short. For example, a customer may short some or all the channels together to increase the current amount in a single chain, or series load of LEDs.

Another advantage is that the circuits according to the techniques of this disclosure do not need a dedicated digital communication bus. No digital info needs to be provided from the external system, such as the number of LEDs in each series load of LEDs. Avoiding the need for a digital bus may reduce cost and complexity of applications that may use the circuits of this disclosure.

FIG. 2A is a schematic and block diagram illustrating an example low side driver, multi-channel circuit driving multiple series loads of LEDS. Circuit 40 depicted by FIG. 2A functions similar to circuit 10 of FIG. 1A, with the exception that the current sources 14-18 are connected to the cathode side of series loads 32A-32C as low side drivers. Reference numbers that are the same between FIGS. 1A and 2A, as well as the other figures of this disclosure, indicate components that have the same function and performance.

Similar to circuit 10, described above in relation to FIG. 1A, circuit 40 may include current sources 14-18 to deliver, or sink, to each output element of one or more output elements (34A-34C) of the circuit, an output current (Iout1-Iout3) from a series load (32A-32C) coupled to each output element. Circuit 40, which includes both circuit 40A and the current sources 14-18, may be considered a short detection circuit. In other examples, circuit 40A may be considered the short detection circuit and be separate from the current source circuitry, but connected to the current source outputs 34A-34C via terminals 36A-36C.

Vbat 12 functions the same as described above in relation to FIG. 1A. Vbat 12 connects to the anode side of each series load 32A-32C. Current source 14 connects to series load 32A, which includes LED 25. Likewise, current source 16 connects to series load 32B and current source 18 connects to series load 32C. Current sources 14-18 sink the sourced current to ground in the example of FIG. 2A of a low side driver.

Circuit 40A may be considered a short detection circuit of circuit 40. Circuit 40A includes selector circuit, maximum selector 30, a comparison circuit, comparator 22, a threshold voltage, Vthresh 24A and an output Vflag 28. Circuit 40A may be coupled to each series load 32A-32C via terminals 36A-36C and receives the load voltages Vout1-Vout3. Respectively, terminal 36A connects to the cathode side of series load 32A and receives load voltage Vout1, terminal 36B connects to the cathode side of series load 32B and receives load voltage Vout2, terminal 36C connects to the cathode side of series load 32C and receives load voltage Vout3. Terminal 36B is not labeled in FIG. 2A to simplify the diagram.

As described above for FIG. 1A, load voltages Vout1-Vout3 depend on the series load rather than the output of the current sources 14-18. The selector circuit of circuit 40A is a maximum selector 30. As with minimum selector 20, maximum selector 30 may be implemented using various techniques including logic circuits, microprocessor circuits, and other types of circuits that may be built of discrete components, integrated circuits (IC) or similar techniques. Maximum selector 30 receives a plurality of input voltages and selects the voltage that has the highest voltage value. Where each LED of series loads 32A-32C is $V_{LED}$, each series load voltage would be approximately equal. In other words:

$$V_{out1}=V_{out2}=V_{out3}=V_{bat}-N\times V_{LED}=V_{bat}-3\times V_{LED}$$

and the output of maximum selector 30, Vselect 38A may be approximately Vbat−3$V_{LED}$. However, in the example in which LED 25 fails because of a short circuit, then Vout1=Vbat−2×$V_{LED}$ and maximum selector 30 would select the highest voltage. Therefore $V_{SELECT}$=Vout1=Vbat−2$V_{LED}$.

Circuit 40A includes a comparison circuit, comparator 22. In other examples, circuit 40A may include other types of comparison circuits. Comparator 22 receives Vselect 38 into the non-inverting input and compares Vselect 38 to a predetermined threshold voltage Vbat 12−$V_{THRESH}$ 24A. In response to the selected series load voltage, Vselect 38 satisfying the predetermined threshold voltage value Vbat 12−$V_{THRESH}$ 24A, the short detection circuit, circuit 40A may be configured to output a short detection signal at the short detection output, which is the output of comparator 22, Vflag 28, in the example of FIGS. 1A-4A.

FIG. 2B is a conceptual timing graph that depicts the operation of a short detection circuit with a low side connected driver circuit, in accordance with one or more techniques of this disclosure. The timing graph of FIG. 2B depicts the operation of FIG. 2A in the example where LED 25 has a short circuit failure, similar to FIG. 1B above.

The timing graphs of FIG. 2B include a graph of Vout1, a combined graph of Vout2 and Vout 3, a graph of Vbat 12−Vselect 38 and a graph of Vflag 28. LED 25 develops a short circuit in the period t0 to t1, which means $V_{LED}$ 25 is approximately zero during the period t0 to t1. Vout1 is the series load voltage for series load 32A, and in the examples of FIGS. 1B-4B, all LED voltage drops are approximately the same value, $V_{LED}$. Therefore, during the period t0 to t1, Vout1 will increase from approximately Vbat−3$V_{LED}$ to approximately Vbat−2$V_{LED}$. The other series load voltages, Vout2 and Vout3 remain approximately constant during the period t0 to t1.

The selector circuit configured to receive a series load voltage Vout1-Vout3 from each output element 34A-34C of the one or more output elements is maximum selector 30. Maximum selector 30 may be configured to select the maximum series load voltage and from the one or more output elements. At time t0, maximum selector 30 selects Vout1 and outputs Vout1 as Vselect 38. Therefore, at approximately t0, Vselect will also be approximately Vbat−2$V_{LED}$.

Vthresh 24A, in the example, may be selected to be some fraction of $V_{LED}$. In the example of FIGS. 2A and 2B, the input to the non-inverting input of comparator 22 is depicted as approximately $$Vbat-Vthresh=Vbat-(3\times V_{LED}-0.5\times V_{LED})=Vbat-2.5\times V_{LED}.$$

In other examples, the fraction of $V_{LED}$ may be different than ½ $V_{LED}$, such as ¾, ¼ or some other fraction of $V_{LED}$ that ensures the short detection circuit will detect a single shorted load in a series load, while avoiding a false detection indication.

Short detection circuit 40A may be configured to compare the selected series load voltage Vselect 38 to the predetermined a threshold voltage value, Vbat 12−Vthresh 24A, as described above. In response to the selected series load voltage Vselect 38 satisfying the predetermined threshold voltage value Vbat 12−Vthresh 24A, the short detection circuit may be configured to output a short detection signal Vflag 28 at the single short detection circuit output. In the example of FIG. 2A, a low side driver circuit, Vselect 38 satisfies the threshold Vbat 12-Vthresh 24A when Vselect 38 is more than the threshold (Vselect>Vbat 12−Vthresh24A). In some examples, circuit 40A may be configured for Vselect 38 to satisfy the threshold when Vselect 38 is greater than or equal to the threshold Vbat 12−Vthresh 24A.

At approximately time t0, Vselect 38 satisfies the threshold Vbat 12-Vthresh 24A and comparator 22 may output the short detection signal Vflag 28. At approximately time t1, the short circuit failure in LED 25 no longer exists, and Vout1 decreases to Vbat−$3V_{LED}$ causing Vselect 38 to also decrease to Vbat−$3V_{LED}$. At time t1, Vselect 38 no longer satisfies the threshold Vbat 12-Vthresh 24A. In response, comparator 22 may cease to output the short detection signal Vflag 28 at time t1.

FIG. 3A is a schematic and block diagram illustrating an example multi-channel high side driver circuit driving a single series load that may be used to detect a shorted load in a series of loads, according to one or more techniques of this disclosure. Circuit 50, may include current sources 14-18 to deliver to each output element of one or more output elements (34A-34C) shorted together, an output current to drive one series load 32A coupled to each output element. Circuit 50, which includes both circuit 50A and the current sources 14-18, may be considered a short detection circuit. In other examples, circuit 50A may be considered the short detection circuit and be separate from the current source circuitry, but connected to the current source outputs 34A-34C via terminals 36A-36C.

As with all FIGS. 1A-4A, current sources 14-18 may be any current source, such as a current regulator, that may supply current. Current sources 14-18 receive power from Vbat 12, as depicted in the examples of FIGS. 1A-4A, however, Vbat may indicate any power source, such as a regulated power supply, and need not be limited to a battery. Each current source includes an output element (34A-34C). Current sources 14-18 combine to supply an output current (Iout1+Iout1+Iout3=3×$I_{OUTi}$) to the anode side of series load 32A coupled to each output element 34A-34C. The cathode side of series load 32A is coupled to ground.

Figure 4A:
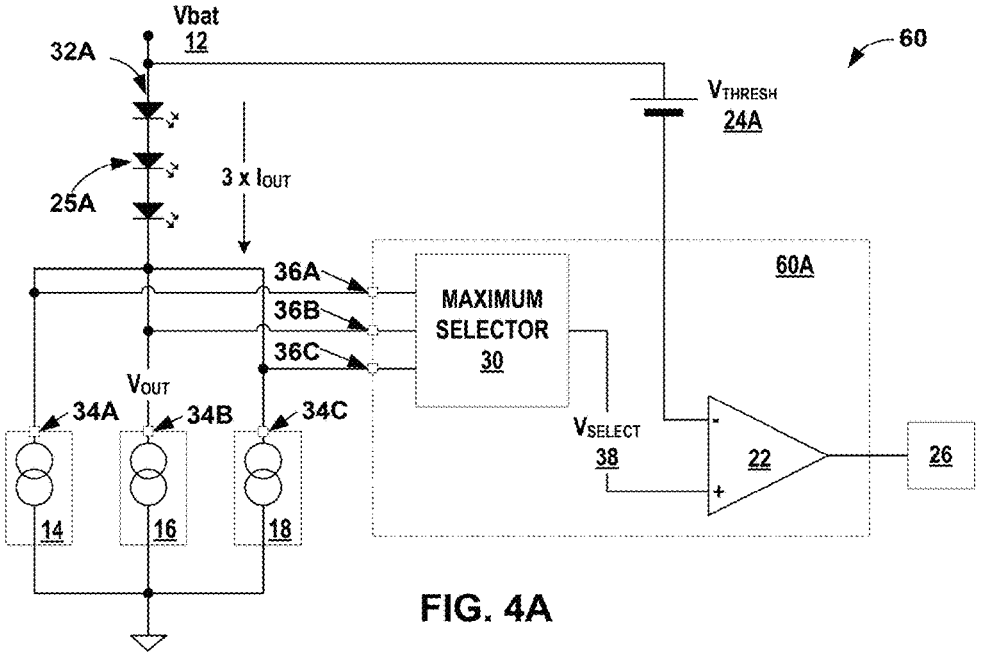
FIG. 4A is a schematic diagram illustrating an example low side driver, multi-channel circuit driving single series load of LEDS.

FIG. 3A, and FIG. 4A described below, may be considered a multi-channel circuit supplying a single channel, or single series load. The examples of FIGS. 3A and 4A depict a three-channel driver supplying a single series load. In other examples, more than three channels may supply a single load. In other examples, current sources 14 and 16 may combine to supply a single series load, while current source 18 also supplies a second series load. Other examples may include any combination of channels and series loads.

Current sources 14-18 connect to series load 32A, which includes LED 25A. The other LEDs in series load 32A are not numbered to simplify the figure. The example of FIG. 3A depicts series load 32A as including three LEDs, but in other examples, the series load may include any number of LEDs.

Circuit 50A may be considered a short detection circuit of circuit 50. Circuit 50A includes selector circuit, minimum selector 20, a comparison circuit, comparator 22, a threshold voltage, Vthresh 24 and an output Vflag 28. Circuit 50A may be coupled to series load 32A via terminals 36A-36C and receives the load voltages Vout1-Vout3, which in the example of FIG. 3A is a single voltage Vout. Terminals 36A-36C connect to the anode side of series load 32A to detect any short circuit failures in the high side driver circuit 50.

Load voltage Vout depends on the series load rather than the output of the current sources 14-18, as described above. All LED voltage drops in series load 32A are approximately the same in the example of FIG. 3A, therefore series load voltage Vout is Vout=N×$V_{LED}$=3×$V_{LED}$, where N is an integer representing the number of loads in series load 32A.

The selector circuit of circuit 50A is a minimum selector 20, similar to depicted in FIG. 1A. Minimum selector 20 receives a plurality of input voltages and selects the voltage that has the lowest voltage value. In the example of circuit 50, there is only a one series load voltage Vout so $V_{SELECT}$=Vout. In other examples, such as the combination examples described above, minimum selector 20 may function similar to the function described in relation to FIG. 1A. Circuit 50 depicts one of the advantages of the short detection circuits according to the techniques of this disclosure. The same multi-channel short detection circuit may be used with multiple series loads or a single series load in any combination as will be described in further detail below.

The comparison circuit of circuit 50A, comparator 22, receives Vselect 38 into the inverting input and compares Vselect 38 to a predetermined threshold voltage Vthresh 24. In response to the selected series load voltage, Vselect 38 satisfying the predetermined threshold voltage value Vthresh 24, circuit 50A may be configured to output a short detection signal Vflag 28 at the short detection output, the output of comparator 22.

Other digital or analog circuits 26 may receive short detection signal Vflag 28 from the output of circuit 50A and use Vflag to perform other functions. As described above, other functions may include sending a warning message or activating a warning indicator, such as an indicator light, that informs a user that there may be a short in one of the LEDs of the series LEDs.

Figure 3B:
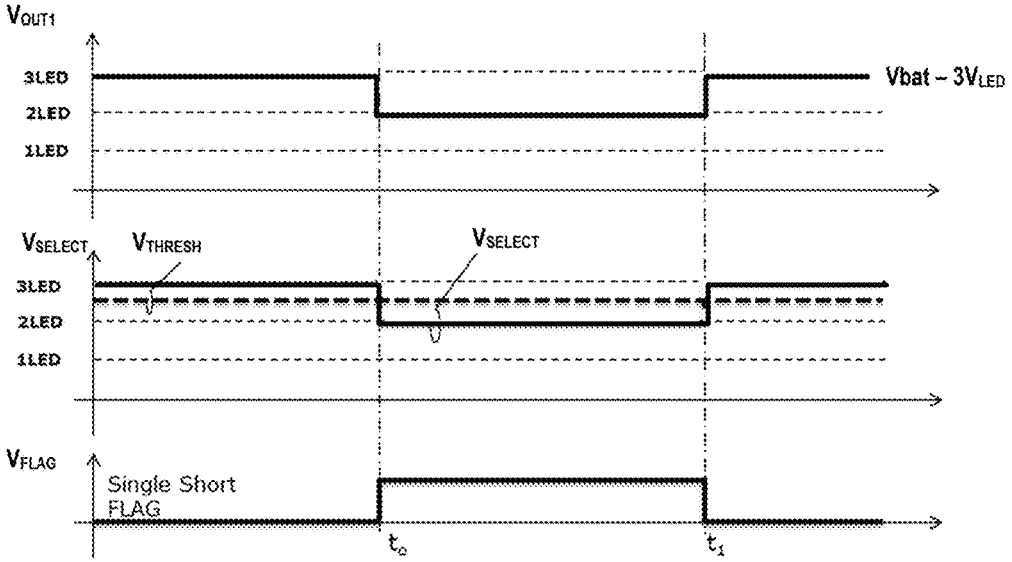
FIG. 3B is a conceptual timing graph that depicts the operation of a short detection circuit with a multi-channel high side connected driver circuit driving a single LED series load, in accordance with one or more techniques of this disclosure.

FIG. 3B is a conceptual timing graph that depicts the operation of a short detection circuit with a multi-channel high side connected driver circuit driving a single LED series load, in accordance with one or more techniques of this disclosure. The timing graph of FIG. 3B depicts the operation of FIG. 3A in the example where LED 25A has a short circuit failure.

The timing graphs of FIG. 3B include a graph of Vout, a graph of Vselect 38 and a graph of Vflag 28. LED 25 develops a short circuit in the period t0 to t1, which means $V_{LED25}$ is approximately zero during the period t0 to t1. Vout is the series load voltage for series load 32A, and in the example of FIG. 3B, all LED voltage drops are approximately the same value, $V_{LED}$. Therefore, during the period t0 to t1, Vout will decrease from approximately $3V_{LED}$ to approximately $2V_{LED}$. Therefore, at approximately t0, Vselect will also decrease to approximately $2V_{LED}$.

Vthresh 24 may be selected in the same manner as described above for FIG. 1B, which is another advantage of the short detection circuits according to the techniques of this disclosure. Selecting Vthresh 24 depends on knowing $V_{LEDi}$ of the LEDs in the one or more LED series loads. This simplifies selecting Vthresh 24 when compared to other examples of short detection circuits.

As in the examples above with the multi-channel driver circuit driving multiple series loads, the short detection circuit may be configured to compare the selected series load voltage Vselect 38 to the predetermined a threshold voltage value, Vthresh 24. In response to Vselect 38 satisfying the predetermined threshold voltage value Vthresh 24, the short detection circuit may be configured to output a short detection signal Vflag 28 at the single short detection circuit output. In the example of FIG. 3A, a high side driver circuit with a single LED series load, Vselect 38 satisfies the threshold Vthresh 24 when Vselect 38 is less than Vthresh 24 (Vselect<Vthresh). In some examples, circuit 50A may be configured for Vselect 38 to satisfy the threshold when Vselect 38 is less than or equal to Vthresh 24 (Vselect≤Vthresh).

At approximately time t0, Vselect 38 satisfies Vthresh 24 and comparator 22 may output the short detection signal Vflag 28. At approximately time t1, the short circuit failure in LED 25 no longer exists, and Vout rises back to $3\times V_{LED}$. Vselect 38 also increases to $3\times V_{LED}$, and no longer satisfies the threshold Vthresh 24. In response, comparator 22 may cease to output the short detection signal Vflag 28 at time t1.

FIG. 4A is a schematic diagram illustrating an example low side driver, multi-channel circuit driving single series load of LEDS. Circuit 60 depicted by FIG. 4A functions similar to circuit 40 of FIG. 2A. Reference numbers that are the same as the other figures of this disclosure, indicate components that have the same function and performance.

Circuit 60 may include current sources 14-18 to deliver, or sink, to each output element of one or more output elements (34A-34C) shorted together, an output current to drive one series load 32A coupled to each output element. Circuit 60, which includes both circuit 60A and the current sources 14-18, may be considered a short detection circuit. In other examples, circuit 60A may be considered the short detection circuit and be separate from the current source circuitry, but connected to the current source outputs 34A-34C via terminals 36A-36C.

Vbat 12 is as described above in relation to FIG. 1A. Vbat 12 connects to the anode side of series load 32A. Current source 14-18 connect to series load 32A, which includes LED 25A. Current sources 14-18 sink the sourced current to ground. The other LEDs in series load 32A are not numbered to simplify the figure. The example of FIG. 4A depicts series load 32A as including three LEDs, but in other examples, the series load may include any number of LEDs.

Circuit 60A may be considered a short detection circuit of circuit 60. Circuit 60A includes selector circuit, maximum selector 30, a comparison circuit, comparator 22, a threshold voltage, Vthresh 24A and an output Vflag 28. Circuit 60A may be coupled to series load 32A via terminals 36A-36C and receives the load voltages Vout1-Vout3, which in the example of FIG. 4A is a single voltage Vout. Terminals 36A-36C connect to the anode side of series load 32A to detect short circuit failures in the low side driver circuit 60.

As with FIG. 2B, load voltage Vout depends on the series load rather than the output of the current sources 14-18. All LED voltage drops in series load 32A are approximately the same in the example of FIG. 4A, therefore series load voltage Vout is $Vout=Vbat-N\times V_{LED}=Vbat-3\times V_{LED}$, where N is an integer representing the number of loads in series load 32A.

The selector circuit of circuit 60A may comprise a maximum selector 30, similar to depicted in FIG. 2A. Maximum selector 30 receives a plurality of input voltages and selects the voltage that has the highest voltage value. In the example of circuit 60, there is only a one series load voltage Vout so $V_{SELECT}$=Vout. In other examples, such as the combination examples described above, maximum selector 30 may function similar to the function described in relation to FIG. 2A. Circuit 60 depicts one of the advantages of the short detection circuits according to the techniques of this disclosure. The same multi-channel short detection circuit may be used with multiple series loads or a single series load in any combination, either with a high side driver or low side driver circuit.

The comparison circuit of circuit 60A, comparator 22, receives Vselect 38 into the non-inverting input and compares Vselect 38 to a predetermined threshold voltage Vbat 12$-V_{THRESH}$ 24A. In response to the selected series load voltage, Vselect 38 satisfying the predetermined threshold voltage value Vbat 12$-V_{THRESH}$ 24A, circuit 60A may be configured to output a short detection signal Vflag 28 at the short detection output, the output of comparator 22.

Other digital or analog circuits 26 may receive short detection signal Vflag 28 from the output of circuit 60A and use Vflag to perform other functions. As described above, other functions may include sending a warning message or activating a warning indicator, such as an indicator light, that informs a user that there may be a short in one of the LEDs of the series LEDs.

Figure 4B:
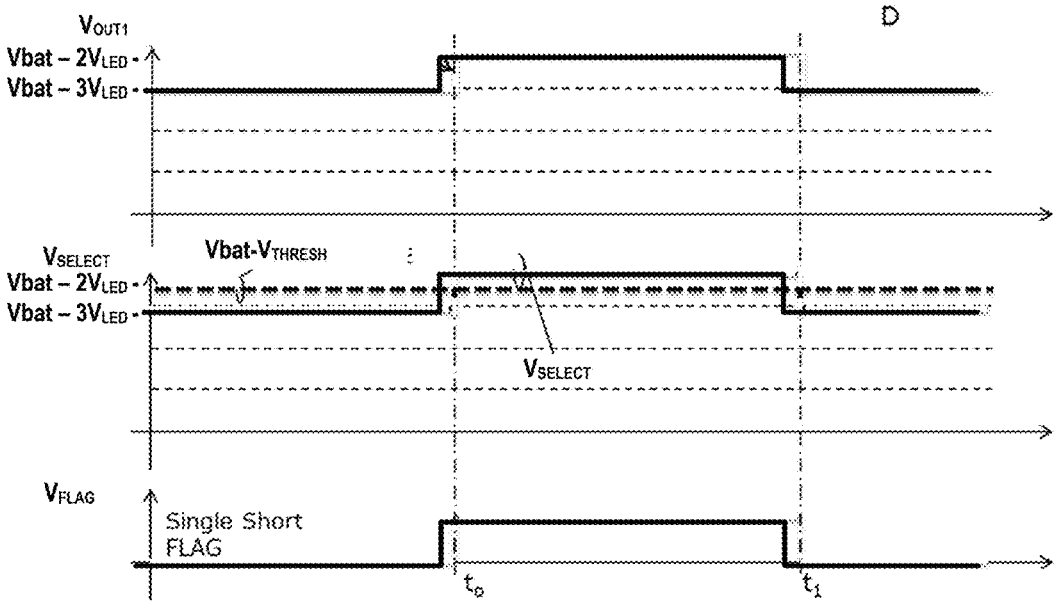
FIG. 4B is a conceptual timing graph that depicts the operation of a short detection circuit for a multi-channel low side connected driver circuit supplying one LED series load, in accordance with one or more techniques of this disclosure.

FIG. 4B is a conceptual timing graph that depicts the operation of a short detection circuit for a multi-channel low side connected driver circuit supplying one LED series load, in accordance with one or more techniques of this disclosure. The timing graph of FIG. 4B depicts the operation of FIG. 4A in the example where LED 25A has a short circuit failure.

The timing graphs of FIG. 4B include a graph of Vout, a graph of Vselect 38 and a graph of Vflag 28. LED 25 develops a short circuit in the period t0 to t1, which means $V_{LED25}$ is approximately zero during the period t0 to t1. Vout is the series load voltage for series load 32A, and in the example of FIG. 4B, and all LED voltage drops are approximately the same value, $V_{LED}$. Therefore, during the period t0 to t1, Vout will increase from approximately $Vbat-3V_{LED}$ to approximately $Vbat-2V_{LED}$.

The selector circuit configured to receive a series load voltage Vout1-Vout3 from each output element 34A-34C of the one or more output elements is maximum selector 30. Maximum selector 30 may be configured to select the maximum series load voltage and from the one or more output elements. In the example of circuit 60, there is only a one series load voltage Vout so $V_{SELECT}$=Vout. In other examples, such as the combination examples described above, maximum selector 30 may function similar to the function described in relation to FIG. 2A. At time t0, maximum selector 30 outputs Vout as Vselect 38. Therefore, at approximately t0, Vselect will also be approximately $Vbat-2V_{LED}$.

Vthresh 24A may be selected in the same manner as described above for FIG. 2B, which is another advantage of the short detection circuits according to the techniques of this disclosure. As in the examples above with the multi-channel driver circuit driving multiple series loads, the short detection circuit may be configured to compare the selected series load voltage Vselect 38 to the predetermined a threshold voltage value, Vbat 12−Vthresh 24A. In response to Vselect 38 satisfying the predetermined threshold voltage value Vbat 12−Vthresh 24A, the short detection circuit may be configured to output a short detection signal Vflag 28 at the single short detection circuit output.

In the example of FIG. 4A, which is a low side driver circuit, Vselect 38 satisfies the threshold Vbat 12−Vthresh 24A when Vselect 38 is more than Vbat 12−Vthresh 24A (Vselect>Vbat−Vthresh). In some examples, circuit 60A may be configured for Vselect 38 to satisfy the threshold when Vselect 38 is greater than or equal to Vthresh 24A (Vselect≥Vbat−Vthresh).

At approximately time t0, Vselect 38 satisfies Vbat 12−Vthresh 24A and comparator 22 may output the short detection signal Vflag 28. At approximately time t1, the short circuit failure in LED 25 no longer exists, and Vout decreases to Vbat−3$V_{LED}$ causing Vselect 38 to also decrease to Vbat−3$V_{LED}$. At time t1, Vselect 38 no longer satisfies the threshold Vbat 12−Vthresh 24A. In response, comparator 22 may cease to output the short detection signal Vflag 28 at time t1.

Figure 5:
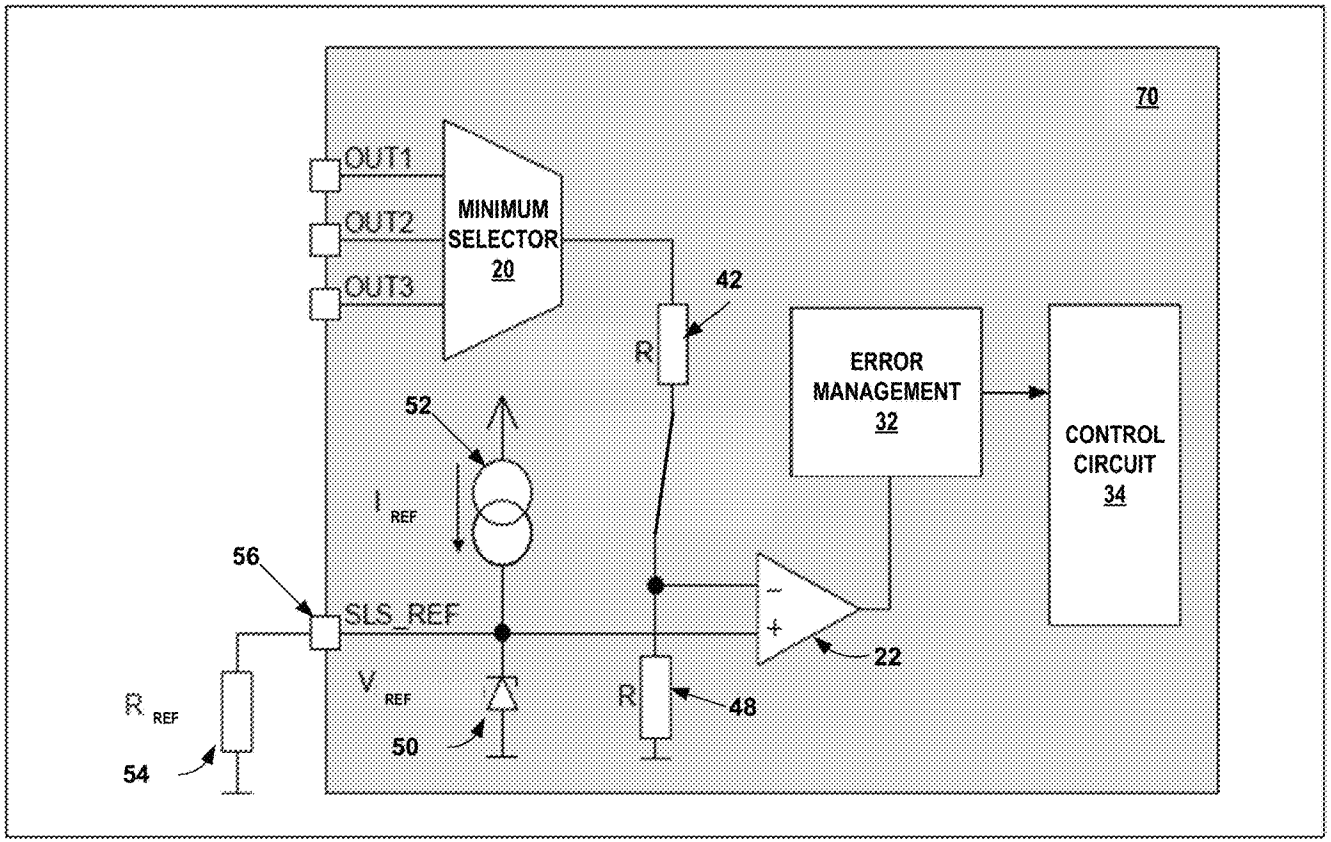
FIG. 5 is a conceptual and schematic block diagram of an example implementation of a short detection circuit in accordance with one or more techniques of this disclosure.

FIG. 5 is a conceptual and schematic block diagram of an example implementation of a short detection circuit in accordance with one or more techniques of this disclosure. Circuit 70 may function similar to circuits 10A and 50A and be used with three channel high side connected driver circuits. This is just one example implementation of a short detection circuit according to the techniques of this disclosure. Other examples may include different components and configurations of components.

Similar to circuits 10A and 50A described above, short detection circuit 70 includes a comparator 22 and a selection circuit, minimum selector 20. Terminals OUT1-OUT3 provide input to minimum selector 20. Terminals OUT1-OUT3 may correlate to terminals 36A-36C depicted in FIGS. 1A-4A. Terminals OUT1-OUT3 may connect to three separate series loads, as depicted in FIGS. 1A and 2A, to a single series load, as depicted in FIGS. 3A and 4A, or any combination of series loads. Other examples of circuit 70 may include more or fewer terminals than the three terminals depicted in FIG. 5.

The output of minimum selector 20 connects to the inverting input of comparator 22 through resistor 42. The inverting input of comparator 22 connects to ground through resistor 48. Resistor 42 and resistor 48 form a voltage divider for the inverting input of comparator 22.

The non-inverting input of comparator 22 receives the threshold voltage setting, which correlates to Vthresh 24 depicted in FIGS. 1A-4A. Current source 52 supplies current Iref to resistor Rref 54 through reference voltage pin 56. Zener diode 50 may be desirable in order to provide protection in case of an overvoltage. In some examples the clamp voltage provided by Zener diode 50 may limit the maximum number of LEDs in a chain of LEDs. A user may choose the value of the threshold voltage by selecting the value of external resistor Rref 54. As described above, the threshold voltage may be selected to be some fraction of $V_{LED}$ less than the expected series load for a fully functional series load. The fraction of $V_{LED}$ may be ½ $V_{LED}$, ⅓, ¼ or some other fraction of $V_{LED}$ that ensures the short detection circuit will detect a single shorted load in a series load while avoiding a false detection indication. The external reference voltage pin 56 provides the user the option to adjust the threshold voltage based on the application, where SLS in FIG. 5 refers to the single LED short (SLS) reference.

The output of comparator 22 may be connected to an error management circuit 32 in the example of FIG. 5. Error management circuit 32 connects to a control circuit 34. Error management circuit 32 and control circuit 34 may correlate to other digital or analog circuits 26 depicted above in FIGS. 1A-4A. The example of circuit 70, has no external, additional or dedicated pins to detect a short circuit failure in a single LED of a chain or string of LEDs.

In operation, circuit 70 may be configured to compare the selected series load voltage, output from minimum selector 20, to the predetermined a threshold voltage value set by resistor Rref 54 as described above. In response to the selected series load voltage as scaled by the voltage divider formed by resistors 42 and 48 satisfying the predetermined threshold voltage value Vthresh 24, short detection circuit 70 may be configured to output a short detection signal, similar to Vflag 28 depicted in FIGS. 1A-4A. In the example of FIG. 5, which will work with a high side driver circuit, minimum selector 20 selects the minimum series load voltage. The selected voltage satisfies the threshold when the selected voltage is less than, or less than or equal t0, the predetermined threshold voltage, such as Vselect<Vthresh, as described above in relation to FIGS. 1A and 3A. In some examples, such as in FIGS. 1A-4A, the scaling factor between the series load voltage and the input to the comparison circuit, e.g. comparator 22, is a scaling factor of 1. Other examples of FIGS. 1A-4A may also include a scaling circuit similar to that depicted in FIG. 5.

The single short detection signal output from comparator 22 may be sufficient to flag a shorted LED, or other load, in any series load connected to terminals out1-out3. As described above, this may provide the advantage of not requiring additional pins or complexity to detect a single short among a plurality of LED series loads. Error management circuit 32 and control circuit 34 may perform other functions in response to receiving the short detection signal. These functions may include sending a warning message or activating a warning indicator, turning off the series load with the shorted LED, activating a backup LED chain or other similar functions.

Figure 6:
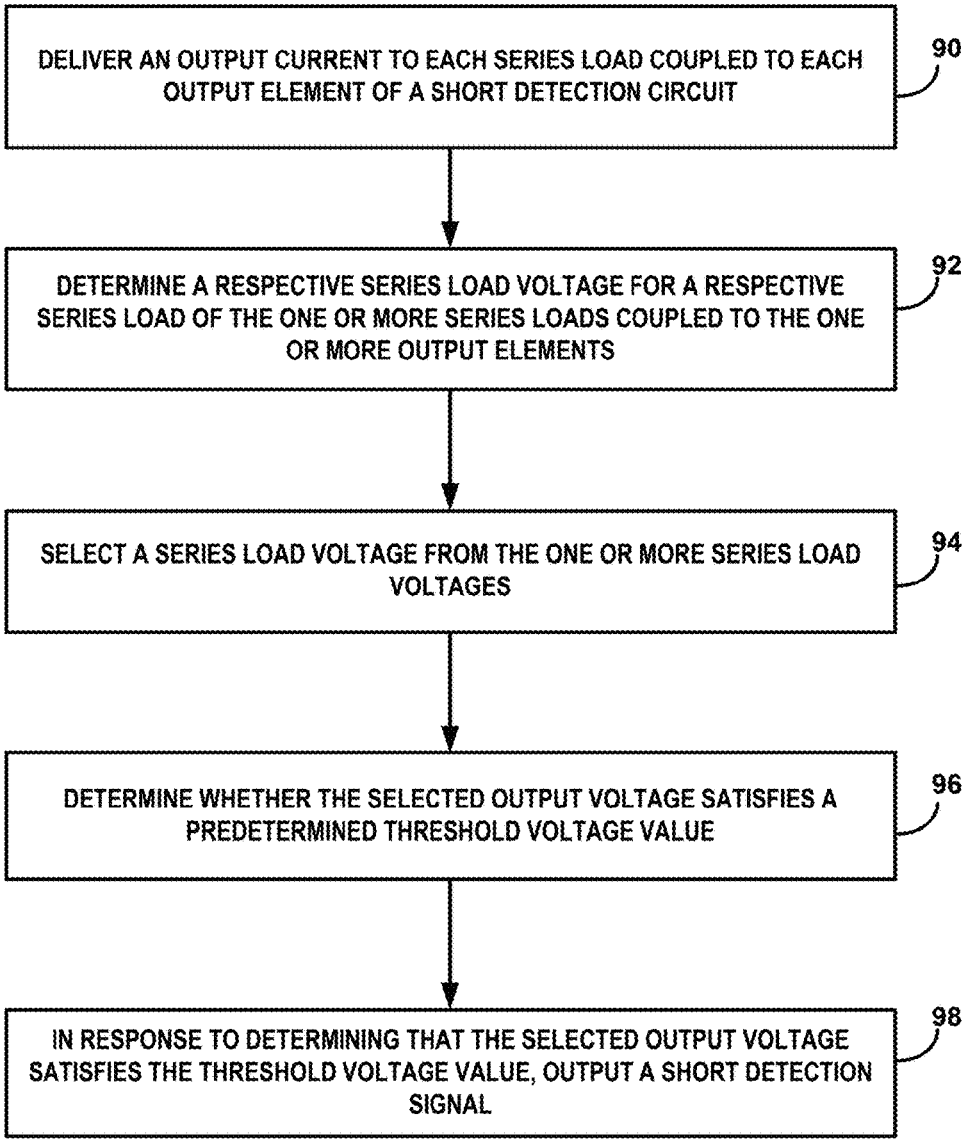
FIG. 6 is a flow chart illustrating an example mode of operation of a circuit device that detects a short circuit in one load of a series of loads, in accordance with one or more techniques of this disclosure.

FIG. 6 is a flow chart illustrating an example mode of operation of a circuit device that detects a short circuit in one load of a series of loads, in accordance with one or more techniques of this disclosure. The steps of FIG. 6 will be described in primarily terms of FIGS. 1A, 1B and 3A, but may apply to other examples.

As described above, circuits 10 and 50, depicted in FIGS. 1A and 3A respectively, may include current sources 14-18 to deliver to each output element of one or more output elements (34A-34C) of the circuit, an output current (Iout1-Iout3) to a series load (32A-32C) coupled to each output element (90). Circuit 10 may be considered a short detection circuit and includes current sources 14-18. In other examples, the short detection circuit may just include circuit 10A, or 50A, which may be separate from the current source circuitry, but connected to the current source outputs 34A-34C via terminals 36A-36C. In other words, in some examples a short detection circuit may include sources, such as current sources, to supply the series loads. In other examples, a short detection circuit may have no sources to supply the series loads, as in the example of circuit 70 depicted in FIG. 5.

Each series load 32A-32C may include N loads, such as N LEDs. Series loads 32A-32C depict a series load with N=3, but in other examples N may be any integer greater than one. The short detection circuit may determine a respective series load voltage (Vout1-Vout3) for a respective series load of the one or more series loads (32A-32C) coupled to the one or more output elements (92). The series load voltage depends on the value of the voltage drops across each load of the N loads, as well as the number (N) of loads. In the example of FIG. 1, series load 32B includes three LEDs (N=3), and each LED voltage drop may be 0.7 V. Therefore, the series load voltage for the respective series load 32B is 3×0.7 V=2.1 V. In other examples, the respective series load may include one or more different types of LEDs with different voltage drops. The respective series load voltage will be the sum of the voltage drops for each LED, or other type of load, in the series load.

The short detection circuit may include a selector, such as a minimum selector 20 or maximum selector 30. In the example of FIG. 1A, minimum selector 20 may select the series load with the minimum series load voltage as a selected series load voltage from the one or more series load voltages. In the example of FIG. 1A, Vout1 may be less than either Vout2 or Vout3 because LED 25 may have a short circuit failure, for example at time $t_0$ in FIG. 1B. In other words, between time $t_0$ and time $t_1$, Vout1 is the minimum series load voltage of the one or more load voltages. Minimum selector 20 selects Vout1 of series load 32A as the selected series load voltage (Vselect 38) from the one or more series load voltages (94). In other examples, such as described above in relation to FIGS. 2A and 4A, maximum selector 30 may select the maximum load voltage as the selected series load voltage from the one or more series load voltages.

Circuit 10A of circuit 10 may include comparator 22, which may compare the selected series load voltage (Vselect 38) to a threshold voltage Vthresh 24. Comparator 22 may determine whether the selected output voltage (Vselect=Vout1) satisfies a predetermined threshold voltage value (Vthresh) (96). In the example of FIG. 1A, Vselect 38 satisfies the predetermined threshold value Vthresh 24 when Vselect 38 is less than Vthresh (Vselect<Vthresh), as depicted in FIG. 1B between times $t_0$ and $t_1$. In some examples, comparator 22 may be configured to output the short detection signal Vflag (28) when Vselect 38 is less than or equal to Vthresh 24 (Vselect≤Vthresh). In other examples, such as the example of FIG. 2A, Vselect 38 satisfies the predetermined threshold value Vthresh when Vselect 38 is greater than Vthresh (Vselect>Vthresh).

In response to determining that the selected output voltage (Vselect=Vout1) satisfies the threshold voltage value (Vthresh), comparator 22 of the short detection circuit may output a short detection signal Vflag 28, such as a at time $t_0$ depicted in FIG. 1B (98). Other digital or analog circuits 26 may receive short detection signal Vflag (28) and use Vflag to perform other functions. In some examples the other functions may include sending a warning message or activating a warning indicator, such as an indicator light that informs a user that there is a short in one of the LEDs of the series LEDs.

Example 1

A circuit comprising a short detection circuit comprising: a single short detection output element; and a selector circuit configured to receive a series load voltage from each output element of the one or more output elements and select one series load voltage from the one or more output elements, wherein the short detection circuit is configured to: compare the selected series load voltage to a predetermined a threshold voltage value, and in response to the selected series load voltage satisfying the predetermined threshold voltage value the short detection circuit is configured to output a short detection signal at the single short detection circuit output.

Example 2

The circuit of example 1, wherein the short detection circuit is configured to output the short detection signal during a startup phase and the short detection circuit is configured to output the short detection signal during a run phase.

Example 3

The circuit of any of examples 1-2 or any combination thereof, further comprising one or more output elements, wherein each output element is configured to deliver an output current to a series load comprising N loads, wherein N is an integer greater than one.

Example 4

The circuit of any combination of examples 1-3, wherein the threshold voltage value is adjustable in response to a user input.

Example 5

The circuit of any combination of examples 1-4, wherein the selector circuit is a minimum selector circuit configured to determine a minimum voltage from among one or more output voltages at the one or more output elements, and select the minimum voltage as the selected output voltage.

Example 6

The circuit of any combination of examples 1-5, wherein the selector circuit is a maximum selector circuit configured to determine a maximum voltage from among one or more output voltages at the one or more output elements, and select the maximum voltage as the selected output voltage.

Example 7

The circuit of any combination of examples 1-6, wherein the short detection signal is configured to be interpreted by an external circuit as an indication that at least one load of the N loads has a short circuit error.

Example 8

A system comprising: a plurality of LED strings, wherein: each LED string in the plurality of LED strings includes N LEDs in series, wherein N is an integer greater than one, and each LED of the N LEDs in an LED string has an expected forward voltage drop; a driver circuit comprising a plurality of output elements, wherein: each respective output element is coupled to a respective LED string, and the driver circuit is configured to deliver a respective output current from each respective output element to each respective LED string; a selector circuit configured to select a series load voltage of a plurality of series load voltages, wherein each respective series load voltage of the plurality of series load voltages corresponds to a respective LED string of the plurality of LED strings; a comparison circuit configured to: determine whether the selected series load voltage satisfies a predetermined threshold voltage value, and in response to determining the selected series load voltage satisfies the predetermined threshold voltage value, output a short circuit detection signal.

Example 9

The system of example 8, wherein the threshold voltage value is set such that the comparison circuit outputs the short detection signal when a single short circuit condition occurs among any of the N LEDs in any LED string of the plurality of LED strings.

Example 10

The system of any combination of examples 8-9, wherein the selector circuit is a minimum selector circuit configured to determine a minimum series load voltage from among the plurality of series load voltages, and select the minimum series load voltage as the selected output voltage each output element of the driver circuit is configured to deliver a respective output current to a respective LED string from the high side of each respective LED string.

Example 11

The system of any combination of examples 8-10, wherein the selector circuit is a maximum selector circuit configured to determine a maximum series load voltage from among the plurality of series load voltages, and select the maximum series load voltage as the selected output voltage each output element of the driver circuit is configured to deliver a respective output current to a respective LED string from the low side of each respective LED string.

Example 12

A method comprising: delivering, by a short detection circuit and to each output element of one or more output elements of the short detection circuit, an output current to each series load coupled to each output element, wherein: each series load comprises N loads, and N is an integer greater than one; determining, by the short detection circuit, a respective series load voltage for a respective series load of the one or more series loads coupled to the one or more output elements; selecting, by the short detection circuit, a selected series load voltage from the one or more series load voltages; determining, by the short detection circuit, whether the selected output voltage satisfies a predetermined threshold voltage value; and in response to determining that the selected output voltage satisfies the threshold voltage value, outputting, by the short detection circuit a short detection signal.

Example 13

The method of example 12, wherein the short detection circuit is configured to deliver the output current to each output element of the one or more output elements at a predetermined duty cycle while the short detection circuit is in an operating mode, wherein the operating mode comprises a startup phase and a run phase, and the short detection circuit is configured to determine whether the first output voltage satisfies a threshold voltage value at any phase of the operating mode.

Example 14

The method of any combination of examples 12-13, wherein the selector circuit is a minimum selector circuit configured to: determine a minimum voltage from among one or more output voltages at the one or more output elements; and select the minimum voltage as the selected output voltage.

Example 15

The method of any combination of examples 12-14, wherein each output element of the short detection circuit is configured to drive each respective series load coupled to each respective output element, from the high side of each respective series load.

Example 16

The method of any combination of examples 12-15, wherein the selector circuit is a maximum selector circuit configured to: determine a maximum voltage from among one or more output voltages at the one or more output elements; and select the maximum voltage as the selected output voltage.

Example 17

The method of any combination of examples 12-16, wherein each output element of the short detection circuit is configured to drive each respective series load, coupled to each respective output element, from the low side of each respective series load.

Example 18

The method of any combination of examples 12-17, wherein each load of each series load of N loads is a light-emitting diode (LED), each of the LEDs has an expected forward voltage drop, and wherein the threshold voltage value is selected such that the threshold voltage value is equal to approximately half of the expected forward voltage.

Example 19

The method of any combination of examples 12-18, wherein the threshold voltage value is adjustable in response to a user input.

Example 20

The method of any combination of examples 12-19, wherein the threshold voltage value is set such that the short detection circuit outputs the short detection signal when a single short circuit condition occurs among any of the N loads in any of the series loads coupled to any of the output elements.

Various examples of the disclosure have been described. These and other examples are within the scope of the following claims.

The invention claimed is:

1. A circuit comprising:

a short detection circuit comprising:

a plurality of current sources, each current source comprising an output element;

a short detection flag output element; and a selector circuit configured to receive a respective series load voltage from each respective output element of the plurality of current sources and select one series load voltage from the plurality of current sources, wherein the short detection circuit is configured to:

compare the selected series load voltage to a predetermined a threshold voltage value, and in response to the selected series load voltage satisfying the predetermined threshold voltage value the short detection circuit is configured to output a short detection signal at the short detection flag output element.

2. The circuit of claim 1, wherein each output element of the plurality of current sources is configured to deliver an output current to a series load comprising N loads, wherein N is an integer greater than one.

3. The circuit of claim 1, wherein the threshold voltage value is adjustable in response to a user input.

4. The circuit of claim 1, wherein the selector circuit is a minimum selector circuit configured to determine a minimum voltage from among the respective series load voltages at the respective output elements, and select the minimum voltage as the selected series load voltage.

5. The circuit of claim 1, wherein the selector circuit is a maximum selector circuit configured to determine a maximum voltage from among the respective series load output voltages at the respective output elements, and select the maximum voltage as the selected series load voltage.

6. The circuit of claim 1, wherein the short detection signal is configured to be interpreted by an external circuit as an indication that at least one load of the N loads has a short circuit error.

7. A system comprising:

one or more LED strings, wherein:

each LED string of the one or more LED strings includes N LEDs in series, wherein N is an integer greater than one, and each LED of the N LEDs in an LED string has an expected forward voltage drop;

a driver circuit comprising a plurality of current sources, wherein each current source of the plurality of current sources includes a respective output element, wherein:

each respective output element is coupled to at least one of the one or more LED strings, and the driver circuit is configured to deliver a respective output current from each respective output element to the one or more LED strings;

a selector circuit configured to select a series load voltage of a plurality of series load voltages, wherein each respective series load voltage of the plurality of series load voltages corresponds to a respective output element;

a comparison circuit configured to:

determine whether the selected series load voltage satisfies a predetermined threshold voltage value, and in response to determining the selected series load voltage satisfies the predetermined threshold voltage value, output a short circuit detection signal.

8. The system of claim 7, wherein the threshold voltage value is set such that the comparison circuit outputs the short detection signal when a short circuit condition occurs among any of the N LEDs in any LED string of the one or more LED strings.

9. The system of claim 7, wherein:

the selector circuit is a minimum selector circuit configured to determine a minimum series load voltage from among the plurality of series load voltages, and select the minimum series load voltage as the selected output voltage each output element of the driver circuit is configured to deliver the respective output current to the one or more LED strings from the high side of the one or more LED strings.

10. The system of claim 7, wherein:

the selector circuit is a maximum selector circuit configured to determine a maximum series load voltage from among the plurality of series load voltages, and select the maximum series load voltage as the selected output voltage each output element of the driver circuit is configured to deliver the respective output current to the one or more LED strings from the low side of the one or more LED strings.

11. A method comprising:

delivering, by a short detection circuit and to each output element of a plurality of output elements of the short detection circuit, an output current to one or more series loads coupled to each output element, wherein:

the output current from each output element is supplied by a separate current source associated with each output element;

each series load comprises N loads, and

N is an integer greater than one;

determining, by the short detection circuit, a respective series load voltage for a respective series load of the one or more series loads coupled to the plurality of output elements;

selecting, by the short detection circuit, a selected series load voltage from the one or more series load voltages;

determining, by the short detection circuit, whether the selected series load voltage satisfies a predetermined threshold voltage value; and in response to determining that the selected series load voltage satisfies the threshold voltage value, outputting, by the short detection circuit a short detection signal.

12. The method of claim 11, wherein:

the short detection circuit is configured to deliver the output current to each output element of the plurality of output elements at a predetermined duty cycle while the short detection circuit is in an operating mode, wherein the operating mode comprises a startup phase and a run phase, and the short detection circuit is configured to determine whether the first output voltage satisfies a threshold voltage value at any phase of the operating mode.

13. The method of claim 11, wherein selecting, by the short detection circuit, the selected series load voltage comprises:

determining a minimum voltage from among one or more series load voltages; and selecting the minimum voltage as the selected series load voltage.

14. The method of claim 13, wherein each output element of the short detection circuit is configured to drive the one or more series loads coupled to the output element, from the high side of the one or more series loads.

15. The method of claim 11, wherein selecting, by the short detection circuit, the selected series load voltage comprises:

determining a maximum voltage from among one or more series load voltages; and selecting the maximum voltage as the selected series load voltage.

16. The method of claim 15, wherein each output element of the short detection circuit is configured to drive the one or more series loads, coupled to the output element, from the low side of the one or more series loads.

17. The method of claim 11, wherein each load of each series load of N loads is a light-emitting diode (LED), each of the LEDs has an expected forward voltage drop, and wherein the threshold voltage value is selected such that the threshold voltage value is equal to approximately half of the expected forward voltage.

18. The method of claim 11, wherein the threshold voltage value is adjustable in response to a user input.

19. The method of claim 11, wherein the threshold voltage value is set such that the short detection circuit outputs the short detection signal when a short circuit condition occurs among any of the N loads in any of the series loads coupled to any of the output elements.

20. The circuit of claim 1, comprising a plurality of output elements, wherein at least two output elements of the plurality of output elements are shorted together to drive a single series load.

* * * * *